US010248153B2

(12) United States Patent
Stoufer et al.

(10) Patent No.: US 10,248,153 B2
(45) Date of Patent: Apr. 2, 2019

(54) SELF-CENTERING MECHANISM FOR A ROTATABLE SHAFT

(71) Applicant: Electrolux Home Products, Inc., Charlotte, NC (US)

(72) Inventors: Paul Stoufer, Lincolnton, NC (US); Thomas Josefsson, Concord, NC (US); Kevin Carpenter, Morrisville, NC (US); Michelle Demers, Morrisville, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 190 days.

(21) Appl. No.: 15/175,693

(22) Filed: Jun. 7, 2016

(65) Prior Publication Data

US 2017/0351292 A1 Dec. 7, 2017

(51) Int. Cl.

| | |
|---|---|
| ***G05G 5/05*** | (2006.01) |
| ***G05G 5/04*** | (2006.01) |
| ***G05G 1/08*** | (2006.01) |

(52) U.S. Cl.

CPC ..... *G05G 5/05* (2013.01); *G05G 1/08* (2013.01); *G05G 5/04* (2013.01)

(58) Field of Classification Search

CPC .. G05G 1/08; G05G 1/10; G05G 5/04; G05G 5/05

See application file for complete search history.

(56) References Cited

U.S. PATENT DOCUMENTS

| | | | | |
|---|---|---|---|---|
| 2,729,485 | A | 1/1956 | Schlage | |
| 4,620,176 | A * | 10/1986 | Hayes | G05G 9/047 200/61.52 |
| 4,844,409 | A | 7/1989 | Lackler et al. | |
| 5,436,413 | A | 7/1995 | Katakami | |
| 5,773,774 | A | 6/1998 | Ramamurthy | |
| 6,274,835 | B1 | 8/2001 | Mo | |
| 6,491,327 | B1 | 12/2002 | Fan | |
| 6,926,319 | B2 | 8/2005 | Bates et al. | |
| 7,171,727 | B2 | 2/2007 | Wylie et al. | |

(Continued)

FOREIGN PATENT DOCUMENTS

| | | | |
|---|---|---|---|
| DE | 4445124 A1 * | 6/1996 | B62M 25/04 |
| DE | 20 2011 103 276 | 1/2012 | |
| GB | 2 190 796 | 11/1987 | |

*Primary Examiner* — Adam D Rogers

(74) *Attorney, Agent, or Firm* — Womble Bond Dickinson (US) LLP

(57) ABSTRACT

A self-centering mechanism for a rotatable shaft includes first and second centering members. Each centering member defines a first and second arcuate slot. A stationary pin extends through the first arcuate slots of the centering members. A rotatable shaft member extends through the centers of the centering members and is disposed between the first and second arcuate slots. A support member extends radially from and is fixed to the shaft member so as to be rotatable therewith. An actuating pin extends from the support member and through the second arcuate slots, and engages the second arcuate slots to rotate one of the first and second centering members. At least one biasing member is in communication with an anchoring structure and rotationally biases at least one of the first and second centering members to a registration position upon release of the rotatable shaft.

19 Claims, 7 Drawing Sheets

(56) References Cited

U.S. PATENT DOCUMENTS

| | | | |
|---|---|---|---|
| 7,586,054 | B2 | 9/2009 | Jin |
| 7,900,978 | B2 | 3/2011 | Zimmer |
| 7,962,106 | B2 | 6/2011 | Gong et al. |
| 8,215,685 | B2 | 7/2012 | Ellis |
| 2005/0156441 | A1 | 7/2005 | Tsai |
| 2006/0125248 | A1 | 6/2006 | Heeley et al. |

* cited by examiner

SELF-CENTERING MECHANISM FOR A ROTATABLE SHAFT

BACKGROUND

Field of the Disclosure

Aspects of the disclosure relate to appliances and, more particularly, to a self-centering mechanism for a rotatable shaft operably engaged with an appliance knob.

Description of Related Art

Modern home appliances may include appropriate components that provide for controlling and/or operating the home appliance. In recent years, advancements and continued developments in sensor technology, encoder technology, and/or processing technology have enabled the implementation of sophisticated control units and/or controllers for home appliances. Various operational components of a home appliance may be controlled via a control unit and/or controller in response to various commands or user selections for controlling such components initiated through a control element such as, for example, an appliance knob.

Some home appliances may include a plurality of control buttons and/or the like configured to provide for incremental changes in an appliance operation. For example, an oven may include a plus symbol button and a minus symbol button on a control panel to increase and decrease the temperature of the oven respectively. Additionally or alternatively, an oven may include the plus button and the minus button on a control panel to incrementally adjust a clock, a timer, and/or the like. Another appliance may utilize a plus button and a minus button to cycle through different appliance functions and/or may include a plurality of buttons to indicate each appliance function available for selection. Thus, it would be desirable to provide an appliance knob with a self-centering mechanism for an appliance control unit and/or controller that would provide improved usability, ergonomics, and user-friendliness when changing an appliance parameter (e.g., oven temperature, cook timer, etc.) and/or an appliance function (e.g., bake, convection bake, broil, etc.). Such a solution should also be capable of implementing a self-centering mechanism that provides controlling operations which are intuitive to the user.

SUMMARY

The above and other needs are met by aspects of the present disclosure which, in one embodiment, provides a self-centering mechanism for a rotatable shaft. In some aspects, the rotatable shaft may be operably engaged with an appliance knob. According to some embodiments, a self-centering mechanism for a rotatable shaft includes a first centering member that defines a first arcuate slot and an opposed second arcuate slot. The self-centering mechanism further includes a second centering member that defines a first arcuate slot and an opposed second arcuate slot. A rotatable shaft member extends through the respective centers of the first and second centering members so as to be disposed between the first arcuate slots and the second arcuate slots. A stationary pin extends through the first arcuate slots of the first and second centering members. A support member extends radially from the rotatable shaft member. The support member may be disposed between the first and the second centering members. The support member may be fixed with respect to the rotatable shaft member so as to be rotatable therewith. The support member may also include an actuating pin that extends from the support member and extends through the second arcuate slots of the first and second centering members. At least one biasing member is in communication with an anchoring structure and is configured to rotationally bias the first and second centering members in opposed rotational directions to a registration position defined by interaction of the first arcuate slots with the stationary pin. The actuating pin is responsive to rotation of the rotatable shaft member in one of the rotational directions to engage the second arcuate slot of one of the first and second centering members and to rotate the one of the first and second centering members with the actuating pin. The one of the first and second centering members is responsive to at least one biasing member to rotate back to the registration position upon release of the rotatable shaft member.

It will be appreciated that the above Summary is provided merely for purposes of summarizing some example embodiments so as to provide a basic understanding of some aspects of the disclosure. As such, it will be appreciated that the above described example embodiments are merely examples of some embodiments and should not be construed to narrow the scope or spirit of the disclosure in any way. It will be appreciated that the scope of the disclosure encompasses many potential embodiments, some of which will be further described below, in addition to those here summarized. Further, other feature, aspects, and advantages of the disclosure will be apparent from a reading of the following detailed description taken in conjunction with the accompanying drawings which illustrate, by way of example, the principles of the described embodiments.

BRIEF DESCRIPTION OF THE DRAWINGS

In order to assist the understanding of aspects of the disclosure, reference will now be made to the appended drawings, which are not necessarily drawn to scale and in which like reference numerals refer to like elements. The drawings are exemplary only, and should not be construed as limiting the disclosure.

DETAILED DESCRIPTION

The present disclosure will now be described more fully hereinafter with reference to exemplary aspects thereof.

These exemplary aspects are described so that this disclosure will be thorough and complete, and will fully convey the scope of the disclosure to those skilled in the art. Indeed, the disclosure may be expressed in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

It should be understood that although the terms first, second, etc. may be used herein to describe various steps or calculations, these steps or calculations should not be limited by these terms. These terms are only used to distinguish one operation or calculation from another. For example, a first calculation may be termed a second calculation, and, similarly, a second step may be termed a first step, without departing from the scope of this disclosure. As used herein, the term "and/or" and the "/" symbol includes any and all combinations of one or more of the associated listed items.

Figure 1:
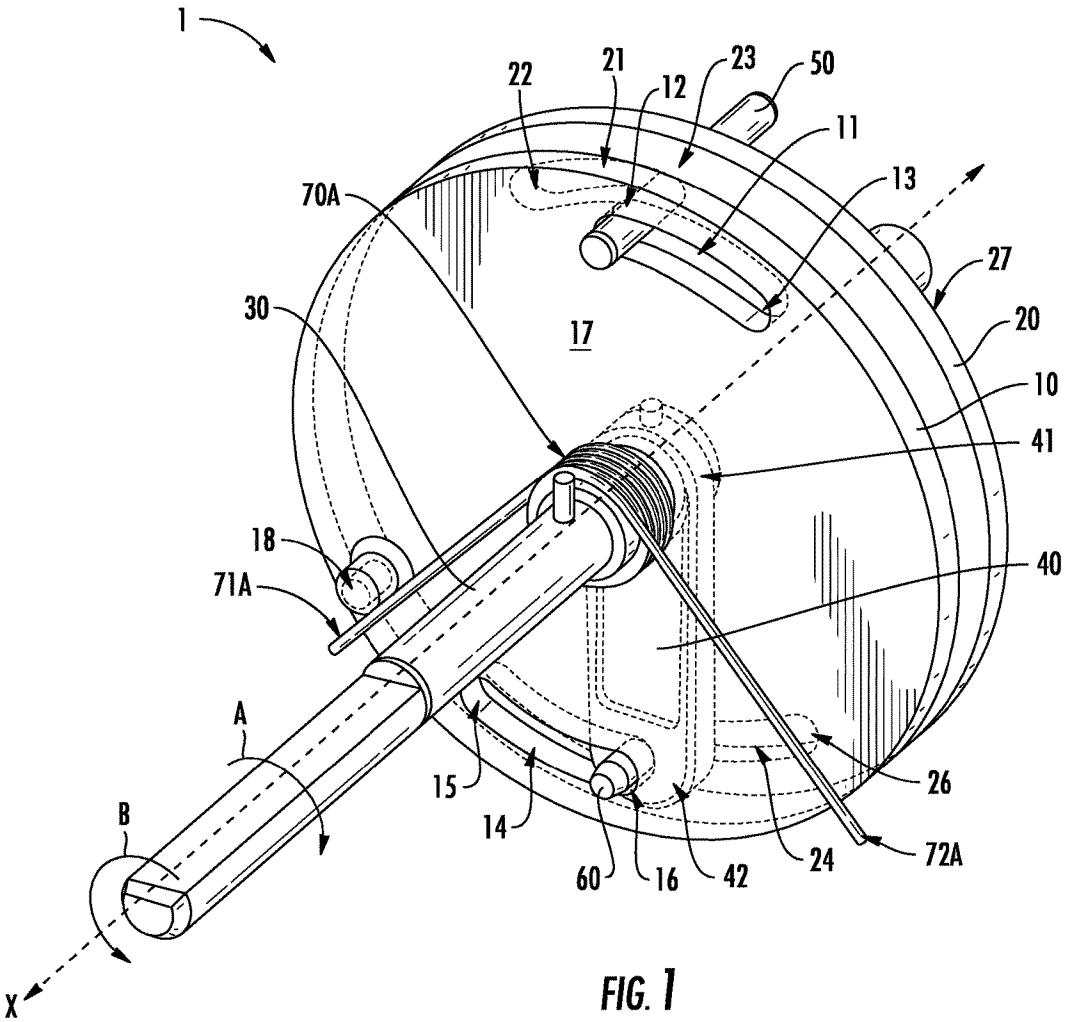
FIG. 1 illustrates a self-centering mechanism for a rotatable shaft disposed in a registration position according to one example aspect of the present disclosure.

As shown in FIG. 1, a self-centering mechanism 1 for a rotatable shaft includes a first centering member 10 and second centering member 20. Additionally, the self-centering mechanism 1 includes a rotatable shaft member 30 that extends through the first centering member 10 and the second centering member 20. In some aspects, the rotatable shaft member 30 may also extend along and define the longitudinal axis X of the self-centering mechanism 1. For example, the rotatable shaft member 30 may extend through the respective centers of the first and second centering members 10, 20 and define the longitudinal axis X of the self-centering mechanism 1, which also may extend through the respective centers of the first and second centering members 10, 20.

Figure 3:
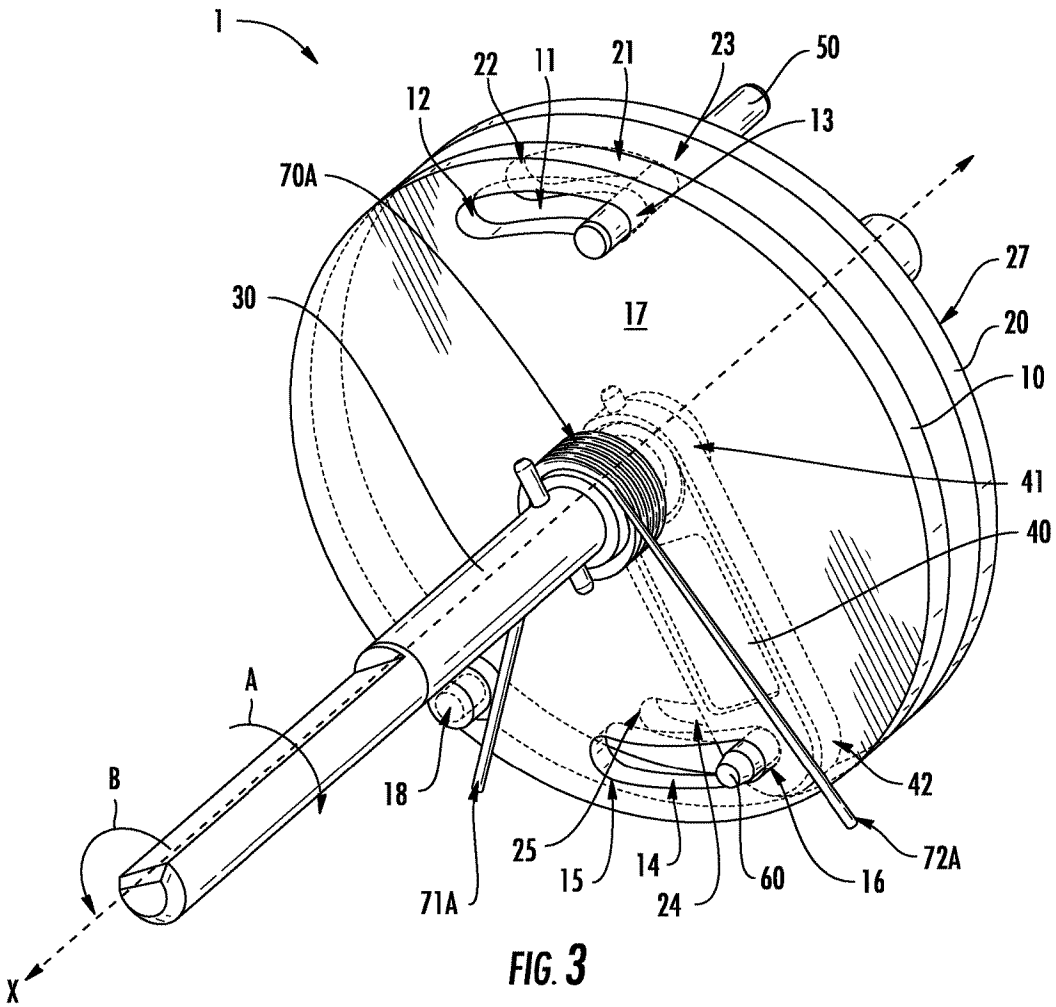
FIG. 3 illustrates the self-centering mechanism of FIG. 1, wherein rotation of a rotatable shaft member from the registration position is limited according to one example aspect of the present disclosure.
Figure 4:
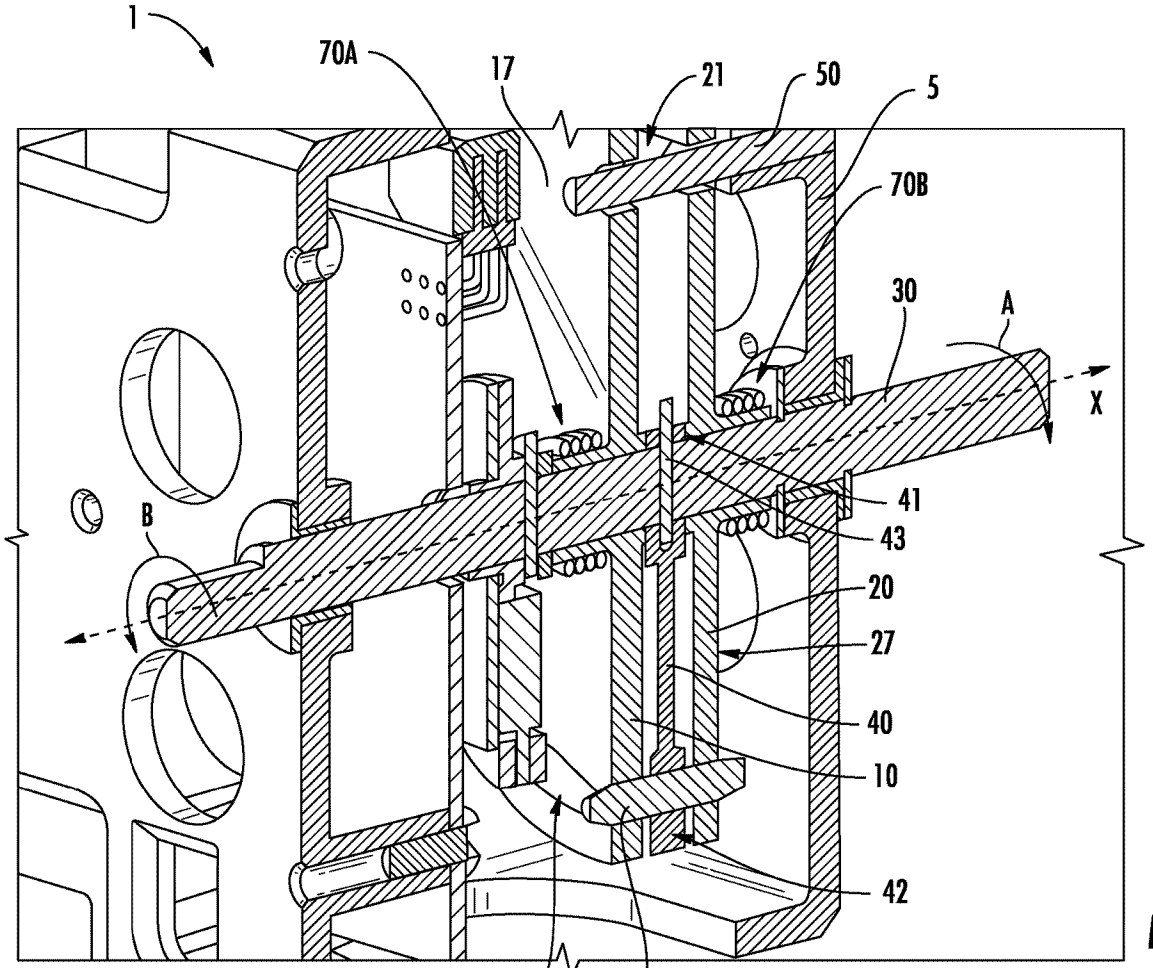
FIG. 4 illustrates a cross-sectional view of a self-centering mechanism disposed in a housing according to one aspect of the present disclosure.
Figure 5A:
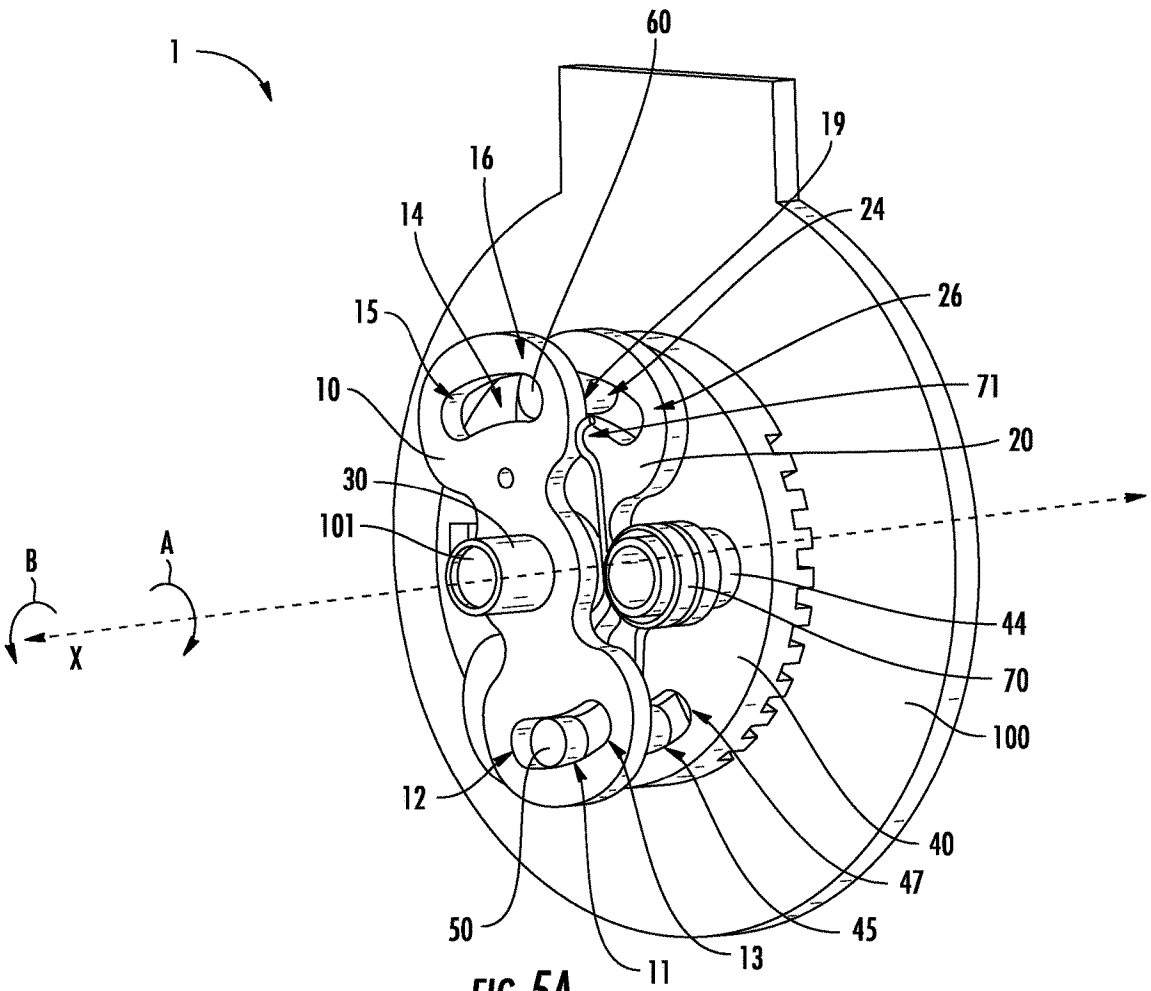
FIG. 5A illustrates a self-centering mechanism for a rotatable shaft disposed in a registration position according to one example aspect of the present disclosure.
Figure 5B:
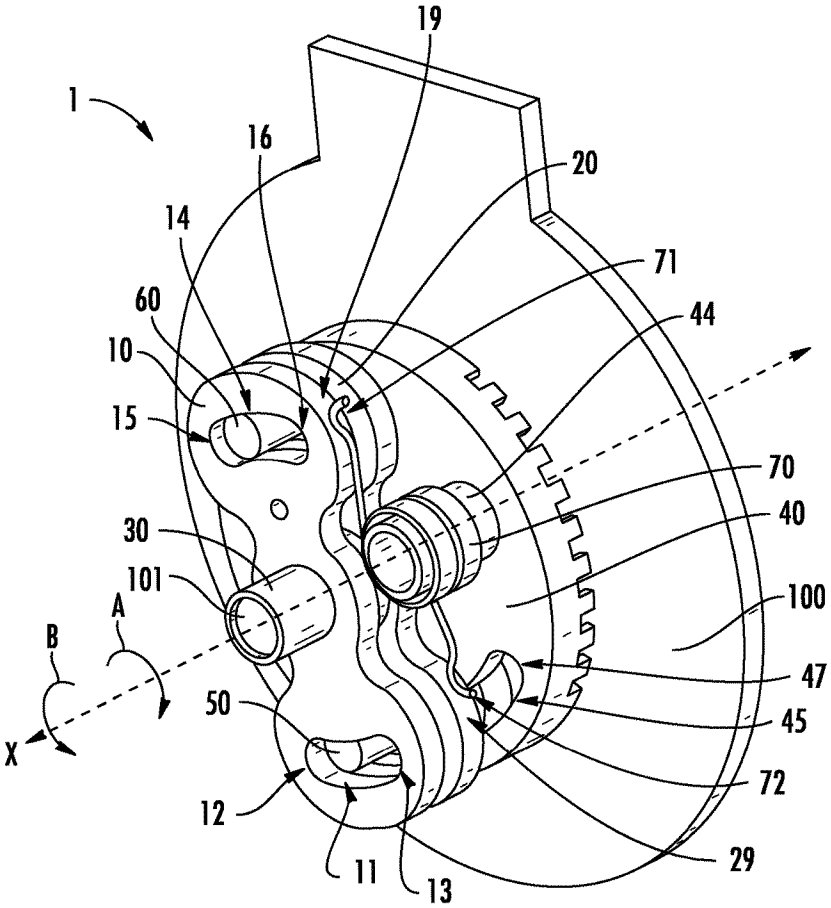
FIG. 5B illustrates the self-centering mechanism of FIG. 5A rotated from the registration position in a first rotational direction according to one example aspect of the present disclosure.
Figure 5C:
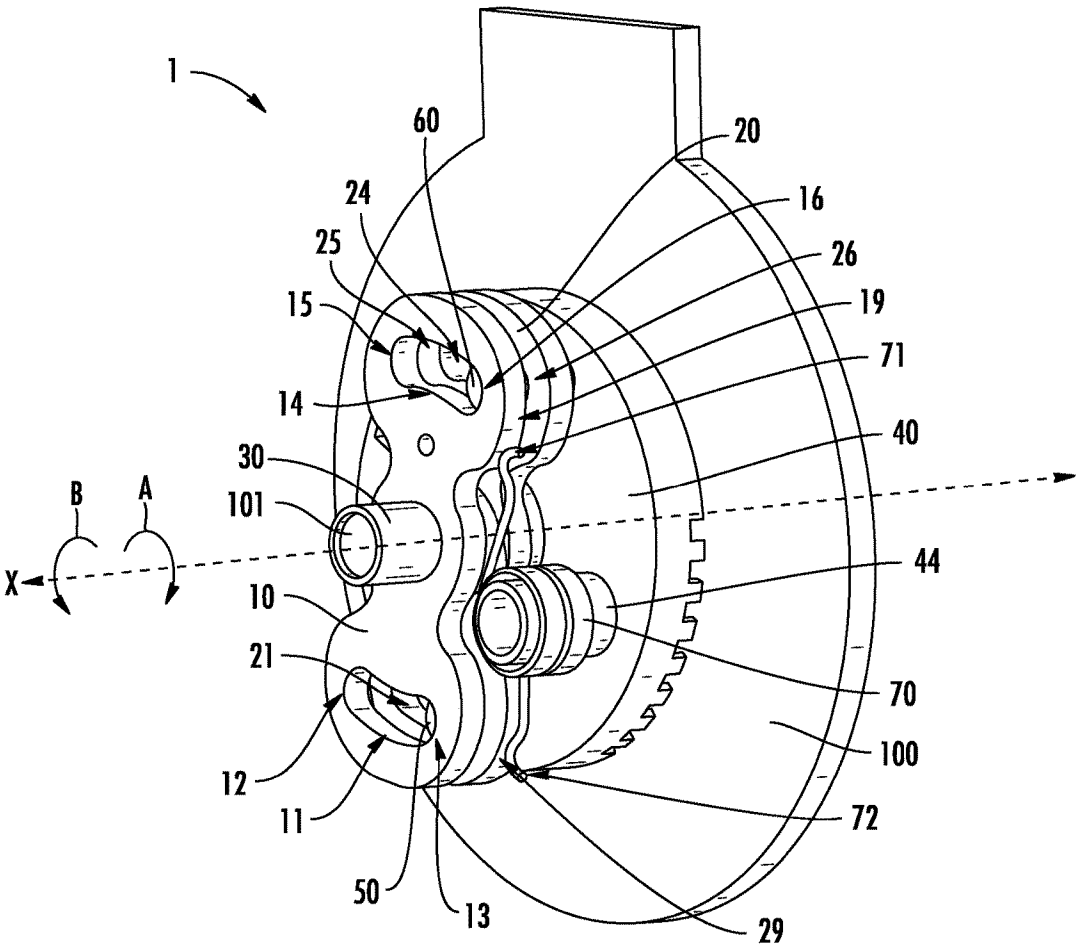
FIG. 5C illustrates the self-centering mechanism of FIG. 5A rotated from the registration position in an opposed second rotational direction according to one example aspect of the present disclosure.

Although FIGS. 1-5C illustrate the rotatable shaft member 30 extending through the respective centers of the first centering member 10 and the second centering member 20, the rotatable shaft member 30 may extend through the first and second centering members 10, 20 at any suitable position. Likewise, the rotatable shaft member 30 may extend along a direction parallel to the longitudinal axis X of the self-centering mechanism, which may extend through the respective centers of the first and second centering members 10, 20. Additionally, although FIGS. 1-4 illustrate the rotatable shaft member 30 being a solid member extending through the respective centers of the first centering member 10 and the second centering member 20, the rotatable shaft member 30 may be shaped as a hollowed cylindrical member, as shown in FIGS. 5A-5C.

Returning to FIG. 1, the first centering member 10 defines a first arcuate slot 11 and a second arcuate slot 14. The first arcuate slot 11 includes a first end 12 and an opposing second end 13, and the second arcuate slot 14 also includes a first end 15 and an opposing second end 16. In some aspects, as shown in FIGS. 1-5C, the first arcuate slot 11 of the first centering member 10 may be disposed substantially diametrically opposite from the second arcuate slot 14 of the first centering member 10.

Like the first centering member 10, the second centering member 20 also defines a first arcuate slot 21 and a second arcuate slot 24. The first arcuate slot 21 of the second centering member 20 also includes a first end 22 and an opposing second end 23, and as particularly shown in FIG. 2, the second arcuate slot 24 of the second centering member 20 also includes a first end 25 and an opposing second end 26. Like the arcuate slots 11, 14 of the first centering member 10, the first arcuate slot 21 of the second centering member 20 may be disposed substantially diametrically opposite from the second arcuate slot 24 of the second centering member 20.

Although FIGS. 1-5C illustrates the arcuate slots 11, 14 of the first centering member 10 and the arcuate slots 21, 24 of the second centering member 20 disposed substantially diametrically opposite from one another on each respective centering member 10, 20, one of ordinary skill in the art may appreciate that the arcuate slots 11, 14, 21, 24 may be disposed at any suitable location with respect to one another on a particular centering member so long as the arrangement of the arcuate slots 11, 14, 21, 24, with respect to one another on the particular centering member, and with respect to the arcuate slots defined by the other centering member, provides for the rotatable shaft member 30 to return to a registration position upon release of the rotatable shaft member 30 disposed in a rotated position, as described in greater detail herein.

The rotatable shaft member 30 may extend through the respective centers of the first and second centering member 10, 20, or at any suitable position between the first and second arcuate slots 11, 14, 21, 24 of the respective centering members 10, 20. For example, as shown in FIG. 1, the rotatable shaft member 30 may extend through the center of the first and second centering members 10, 20 and at a position between the first and diametrically opposed second arcuate slots 11, 14, 21, 24 of the first and second centering members 10, 20. In other instances, one of ordinary skill in the art may appreciate that the rotatable shaft member 30 may extend through the first and second centering members 10, 20 at any suitable position so long as rotation of the rotatable shaft member provides for suitable engagement of the arcuate slots 11, 14, 21, 24 with a stationary pin 50 and/or an actuating pin 60, as described in greater detail herein.

According to some aspects, the first centering member 10 and the second centering member 20 may be substantially similar to one another in shape and size, as shown in FIGS. 1-5C. One of ordinary skill in the art may appreciate, however, that the first and second centering members 10, 20 may be shaped and/or sized differently with respect to one another. For example, the first centering member 10 may define a shape that differs in shape and size from the second centering member 20 (e.g., the first centering member 10 may be a circular centering member with a radius that is greater or smaller than a radius of the second circular centering member 20). In some aspects, the first centering member 10 and the second centering member 20 may define a variety of shapes having, for example, nonlinear peripheral surfaces 19, 29 or peripheral surface portions which may comprise a cam profile (i.e., a nonlinear cam profile). For example, as shown in FIGS. 5A-5C, the first centering member 10 and the second centering member 20 may include nonlinear peripheral surfaces 19, 29, respectively, configured to interact with ends 71, 72 of a biasing member 70 as described in greater detail herein.

Returning to FIG. 1, the self-centering mechanism 1 also includes a stationary pin 50 that extends through the first arcuate slots 11, 21 of the first and second centering members 10, 20 respectively. In particular, the stationary pin 50 extends along a direction parallel to the longitudinal axis X and through the first arcuate slots 11, 21 of the respective centering members 10, 20. Additionally, the stationary pin 50 remains fixed in position with respect to any rotational movement by any of the rotatable shaft member 30, centering members 10, 20 and/or the arcuate slots 11,14, 21, 24 of the centering members 10, 20, and the actuating pin 60. For example, as shown particularly in FIGS. 4 and 5A-5C, the stationary pin 50 may be securely affixed, attached to, and/or integrally formed with a housing 100. Additionally, in some aspects, the housing 100 may include a shaft member support element 101 extending along a direction parallel to the longitudinal axis X. In particular, the shaft member support element 101 may be configured as a solid cylinder for coaxially receiving a rotatable shaft member 30 shaped substantially as a hollow cylindrical member, as shown in FIGS. 5A-5C. In some such aspects, the rotatable shaft member 30 may be integrally formed with the support member 40.

As mentioned previously, the first arcuate slots 11, 21 of the first and second centering members 10, 20 each include a first end 12, 22 and an opposing second end 13, 23. The first centering member 10 may be suitably arranged with respect to the second centering member 20 such that the first arcuate slot 11 of the first centering member 10 is suitable arranged with respect to the first arcuate slot 21 of the second centering member 20 to provide for the self-centering of the self-centering mechanism 1. For example, as shown in FIG. 1, the first centering member 10 may be rotationally offset about the longitudinal axis X with respect to the second centering member 20 such that the first end 12 of the first arcuate slot 11 of the first centering member 10 and the second end 23 of the first arcuate slot 21 of the second centering member 20 are in registration with each other parallel to the longitudinal axis X. Additionally or alternatively, the first centering member 10 may be rotationally offset about the longitudinal axis X with respect to the second centering member 20 such that the stationary pin 50 simultaneously engages opposing ends of the first arcuate slots 11, 21 of the first and second centering member 10, 20 respectively.

In particular, as shown in FIGS. 1 and 5A, when the self-centering mechanism 1 is disposed in a registration position, the first centering member 10 may be rotationally offset about the longitudinal axis X with respect to the second centering member 20, and the stationary pin 50 may be operably engaged with both the first end 12 of the first arcuate slot 11 of the first centering member 10 and the second end 23 of the first arcuate slot 21 of the second centering member 20. As such, when the stationary pin 50 is operably engaged with the first end 12 of the first arcuate slot 11 of the first centering member 10, the stationary pin 50 prevents any further rotation of the first centering member 10 about the longitudinal axis X in the clockwise direction A. Likewise, when the stationary pin 50 is operably engaged with the second end 23 of the first arcuate slot 21 of the second centering member 20, the stationary pin 50 prevents any further rotation of the second centering member 20 about the longitudinal axis X in the counter-clockwise direction B. According to some aspects, the registration position of the self-centering mechanism 1 may be further defined as the position when the rotatable shaft member 30 and/or the appliance knob operably engaged with the rotatable shaft member 30 are disposed in a top dead center position, as shown in FIGS. 1 and 5A.

Figure 2:
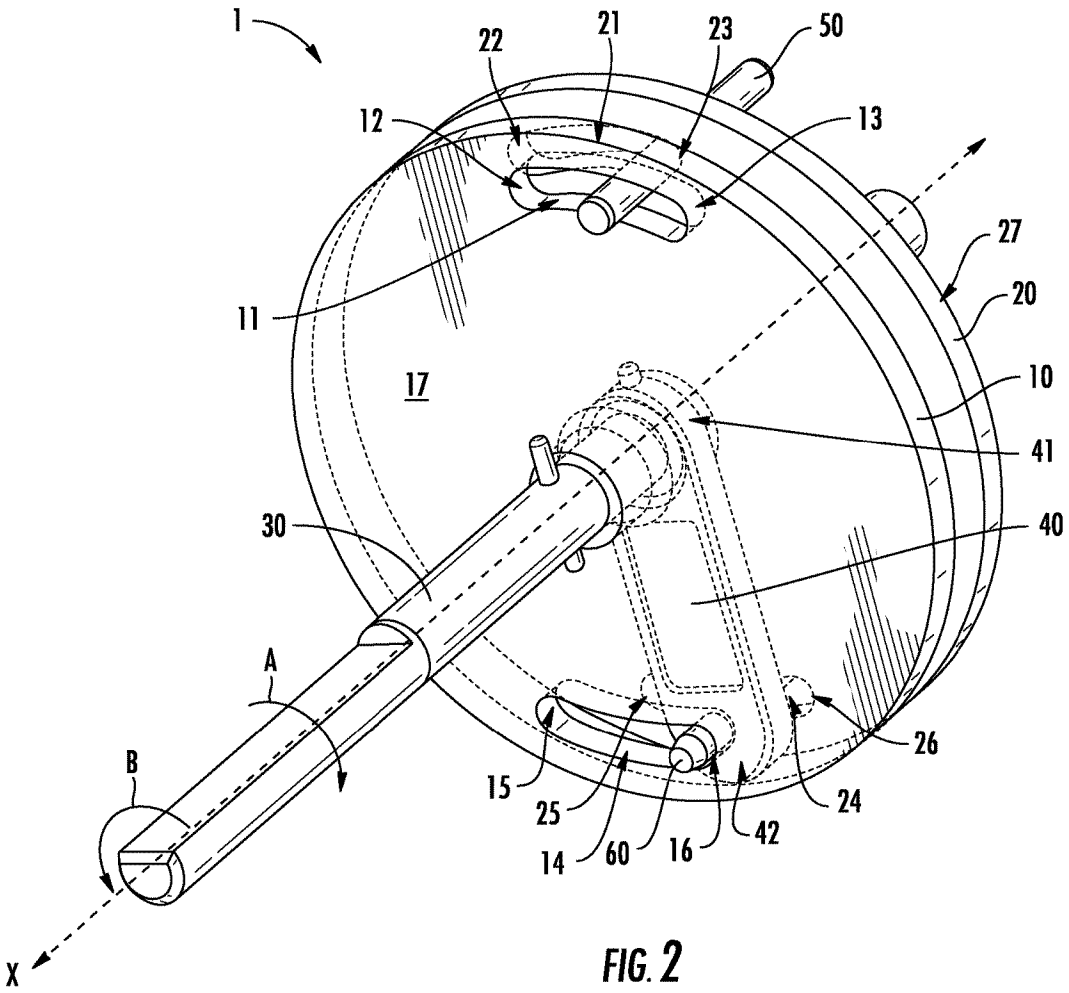
FIG. 2 illustrates the self-centering mechanism of FIG. 1 rotated from the registration position according to one example aspect of the present disclosure.

Additionally or alternatively, when the first centering member 10 is rotated about the longitudinal axis X in the counter-clockwise direction B and away from the registration position, as shown particularly in FIGS. 2 and 3, the stationary pin 50 and the first arcuate slot 11 are configured to prevent further rotation of the first centering member 10 about the longitudinal axis X in the counter-clockwise direction B. In particular, when the stationary pin 50 is operably engaged with the second end 13 of the first arcuate slot 11 of the first centering member 10, the stationary pin 50 prevents any further rotation of the first centering member 10 about the longitudinal axis X in the counter-clockwise direction B. Likewise, when the second centering member 20 is rotated about the longitudinal axis X in the clockwise direction A and away from the registration position, the stationary pin 50 may be operably engaged with the first end 22 of the first arcuate slot 21 of the second centering member 20 and prevent the second centering member from rotating any further about the longitudinal axis X in the clockwise direction A.

According to some aspects, the self-centering mechanism 1 includes a support member 40 extending radially from the rotatable shaft member 30 and orthogonally to the longitudinal axis X of the self-centering mechanism 1. For example, as shown in FIGS. 1-4, the support member 40 may be shaped as an elongated member having a proximal end 41 and an opposing distal end 42. The proximal end 41 of the support member 40 may be engaged with the rotatable shaft member 30, and the support member 40 may extend radially from the rotatable shaft member 30 to the distal end 42.

According to yet another aspect, a support member 40 may extend radially from a rotatable shaft member 30 and may be shaped as a substantially circular disk member, as shown in FIGS. 5A-5C. Additionally, the support member 40 may define an arcuate slot 45 that includes a first end (not shown) and a second end 47. The stationary pin 50 may extend through the arcuate slot 45 of the support member 40, and in particular, may extend through a midpoint of the arcuate slot 45 when the self-centering mechanism 1 is disposed in the registration position. Accordingly, when the support member 40 is rotated about the longitudinal axis X, in either the clockwise direction A and/or the counter-clockwise direction B and away from the registration position, as shown particularly in FIGS. 5B and 5C, the stationary pin 50 and the arcuate slot 45 of the support member 40 are configured to cooperate to prevent further rotation of the support member 40 about the longitudinal axis X in either the clockwise direction A and/or the counter-clockwise direction B. In particular, when the stationary pin 50 is operably engaged with the second end 47 of the arcuate slot 45 of the support member 40, the stationary pin 50 prevents any further rotation of the support member 40 about the longitudinal axis X in the clockwise direction A. Likewise, when the support member 40 is rotated about the longitudinal axis X in the counter-clockwise direction B and away from the registration position, the stationary pin 50 may be operably engaged with the first end (not shown) of the arcuate slot 45 of the support member 40 and prevent the support member from rotating any further about the longitudinal axis X in the counter-clockwise direction B.

In some aspects, the support member 40 may be affixed, secured, or otherwise attached to the rotatable shaft member 30 such that any rotation of the rotatable shaft member 30 about the longitudinal axis X, either in the clockwise direction A and/or the counter-clockwise direction B, causes a portion of the support member 40 to orbit about the rotatable shaft member 30. For example, as shown in FIG. 4, a securing element 43 may affix the support member 40 to the rotatable shaft member 30 and may extend through at least a portion of the support member 40 and the rotatable shaft member 30 such that the distal end 42 of the support member 40 orbits about the rotatable shaft member 30 when the rotatable shaft member 30 rotates in the clockwise direction A and/or the counter-clockwise direction B. According to another aspect, as shown in FIGS. 5A-5C, the support member 40 may be affixed, secured, or otherwise attached to the rotatable shaft member 30 such that rotation of the rotatable shaft member 30 about the longitudinal axis X, either in the clockwise direction A and/or the counter-clockwise direction B, causes peripheral portions of the substantially circular disk-shaped support member 40 to orbit about the rotatable shaft member 30. According to one aspect, rotation of the rotatable shaft member 30 about the longitudinal axis X, either in the clockwise direction A and/or the counter-clockwise direction B, causes the arcuate slot 45 to move with respect to the stationary pin 50 extending therethrough, in an orbit about the shaft member 30. In another aspect, the support member 40 may be integrally formed with the rotatable shaft member 30, as particularly shown in FIGS. 5A-5C.

Additionally, as shown in FIG. 4, the support member 40 may be disposed between the first and second centering members 10, 20. According to some aspects, the support member 40 may be disposed proximate to one of a first surface 17 of the first centering member 10 or a second surface 27 of the second centering member 20. That is, the support member 40 is disposed adjacent to one of the first or second centering members 10, 20, and the first and second centering members 10, 20 are disposed substantially adjacent to one another. For example, as shown in FIGS. 5A-5C, the support member 40 is disposed adjacent to the second centering member 20, and the first and second centering members 10, 20 are disposed substantially adjacent to one another. Accordingly, example arrangements of the first centering member 10, the second centering member 20, and the support member 40 along the longitudinal axis X of the self-centering mechanism 1 may include: 1) support member 40, first centering member 10, and second centering member 20; 2) first centering member 10, second centering member 20, and support member 40, as particularly shown in FIGS. 5A-5C; or 3) first centering member 10, support member 40, and second centering member 20, as particularly shown in FIG. 4.

The self-centering mechanism 1 may further include an actuating pin 60 that extends from the support member member 40 along a direction parallel to the longitudinal axis X of the self-centering mechanism 1, parallel to the stationary pin 50, and/or parallel to the rotatable shaft member 30, and through the second arcuate slots 14, 24 of the first and second centering members 10, 20 respectively. For example, as shown in FIG. 4, the actuating pin 60 extends from the distal end of the support member 40 along a direction parallel to the longitudinal axis X of the self-centering mechanism 1. According to yet another aspect, as shown in FIGS. 5A-5C, the actuating pin 60 extends from a peripheral portion of the support member 40 and along a direction parallel to the longitudinal axis X of the self-centering mechanism 1.

The arrangement of the first and second centering members 10, 20 with respect to one another may provide for the rotation of the self-centering mechanism 1 away from the registration position before the self-centering mechanism 1 returns to the registration position. For example, the arrangement of the first and second arcuate slots on one of the centering members and with respect to the first and second arcuate slots on the other of the centering members, may provide for the rotation of the centering members 10, 20 via the rotatable shaft member 30.

In particular, the first and second centering members 10, 20 may be rotationally or angularly offset about the longitudinal axis X with respect to each other such that the second arcuate slots 14, 24 are also rotationally or angularly offset about the longitudinal axis X with respect to one another. Additionally, the first and second centering members 10, 20 may be arranged such that, when the self-centering mechanism 1 is disposed in the registration position, the actuating pin 60 may be operably engaged with both the second end 16 of the second arcuate slot 14 of the first centering member 10 and the first end 25 of the second arcuate slot 24 of the second centering member 20.

When the rotatable shaft member 30 is rotated about the longitudinal axis X in the counter-clockwise direction B and away from the registration position, as shown in FIGS. 2 and 3, the support member 40 and the actuating pin 60 also rotate or orbit about the longitudinal axis X in the counter-clockwise direction B. In particular, the actuating pin 60 continues to be operably engaged with the second end 16 of the second arcuate slot 14 of the first centering member 10 during rotation of the rotatable shaft member 30 about the longitudinal axis X in the counter-clockwise direction B, and thereby provides for the first centering member 10 to also rotate about the longitudinal axis X in the counter-clockwise direction B and away from the registration position. Additionally, the first arcuate slot 11 of the first centering member 10 is configured such that when the first centering member 10 rotates about the longitudinal axis X in the counter-clockwise direction B via the rotation of the actuating pin 60 about the longitudinal axis X, the first arcuate slot 11 is configured to move freely with respect to the stationary pin 50 until the second end 13 of the first arcuate slot 11 engages the stationary pin 50. Additionally or alternatively, the second arcuate slot 24 of the second centering member 20 may be configured such that when the actuating pin 60 rotates about the longitudinal axis X in the counter-clockwise direction B, thereby providing for the first centering member 10 to rotate about the longitudinal axis in the same direction, the actuating pin 60 is configured to move freely along the second arcuate slot 24 of the second centering member 20 until the actuating pin 60 operably engages the second end 26 of the second arcuate slot 24 of the second centering member 20 and/or until the second end 13 of the first arcuate slot 11 of the first centering member 10 engages the stationary pin 50.

Likewise, the rotatable shaft member 30 may be rotated about the longitudinal axis X in the clockwise direction A and away from the registration position. As the rotatable shaft member 30 rotates about the longitudinal axis X in the clockwise direction A, the support member 40 and the actuating pin 60 also rotate about the longitudinal axis X in the clockwise direction A. In particular, the actuating pin 60 continues to be operably engaged with the first end 25 of the second arcuate slot 14 of the second centering member 20 during rotation of the rotatable shaft member 30 about the longitudinal axis X in the clockwise direction A, and thereby provides for the second centering member 20 to also rotate about the longitudinal axis X in the clockwise direction A and away from the registration position. Additionally, the first arcuate slot 21 of the second centering member 20 is configured such that when the second centering member 20 rotates about the longitudinal axis X in the clockwise direction A via the rotation of the actuating pin 60 about the longitudinal axis X, the stationary pin 50 is configured to move freely along the first arcuate slot 21 until the stationary pin 50 operably engages the first end 22 of the first arcuate slot 11 of the second centering member 20, as described previously herein. Additionally or alternatively, the second arcuate slot 14 of the first centering member 10 may be configured such that when the actuating pin 60 rotates about the longitudinal axis X in the clockwise direction A, thereby providing for the second centering member 20 to rotate about the longitudinal axis X in the same direction, the actuating pin 60 is configured to move freely along the second arcuate slot 14 of the first centering member 10 until the actuating pin 60 operably engages the first end 15 of the second arcuate slot 14 of the first centering member 10 and/or until the first end 22 of the first arcuate slot 21 of the second centering member 20 engages the stationary pin 50.

According to some aspects, the magnitude of rotation of the rotatable shaft member 30, the support member 40, and/or the first and second centering members 10, 20 in either of the clockwise and counter-clockwise directions A, B may be limited by the shape, size, configuration, arrangement, and/or the like of the first arcuate slots 11, 21 and the second arcuate slots 14, 24 of the first and second centering members 10, 20. For example, the first arcuate slots 11, 21 and/or the second arcuate slots 14, 24 may be shaped so as to limit the rotation of the rotatable shaft member 30, the support member 40, and/or the first and second centering members 10, 20 to approximately 30 degrees in either the clockwise and counter-clockwise rotational directions A, B. In particular, the central angles that define the arc lengths of the first arcuate slots 11, 21 and the second arcuate slots 14, 24 may be approximately 30 degrees. As such, when the rotatable shaft member 30 rotates in the counter-clockwise direction B, as shown in FIGS. 2 and 3, the actuating pin 60 rotates the first centering member 10 in the counter-clockwise direction approximately 30 degrees until the actuating pin operably engages both second ends 16, 26 of the second arcuate slots 14, 24 of the first and second centering members 10, 20 and/or until the second ends 13, 23 of the first arcuate slots 11, 21 of the first and second centering members engage the stationary pin 50. Likewise, when the rotatable shaft member 30 is rotated in the clockwise direction A, the actuating pin 60 rotates the second centering member 20 in the clockwise direction A approximately 30 degrees until the actuating pin 60 operably engages the first ends 15, 25 of the second arcuate slots 14, 24 of the first and second centering members 10, 20 and/or until the first ends 12, 22 of the first arcuate slots 11, 21 of the first and second centering members 10, 20 engage the stationary pin 50. Although aspects described herein provide for a self-centering mechanism 1 that is limited to rotate about the longitudinal axis X approximately 30 degrees in either the clockwise and/or counter-clockwise directions A, B, other angular limits to the rotation of the self-centering mechanism 1, the rotatable shaft member 30, support member 40, actuating pin 60, and/or first and second centering members 10, 20 in either the clockwise and/or counter-clockwise directions A, B are also encompassed by the present disclosure.

The self-centering mechanism 1 also includes at least one biasing member (e.g., a first biasing member 70A). In some aspects, as shown in FIG. 4, the at least one biasing member (e.g., a first biasing member 70A) is in communication with an anchoring structure such as, for example the rotatable shaft member 30. As shown in FIG. 4, the self-centering mechanism 1 may include a first biasing member 70A and a second biasing member 70B, which are both in communication with the rotatable shaft member 30. Further, the first and second biasing members 70A, 70B may be configured to rotationally bias the self-centering mechanism 1 to the registration position. For example, the first biasing member 70A may be operably engaged with and configured to rotationally bias the first centering member 10 in the clockwise direction A towards the registration position, while the second biasing member 70B may be operably engaged with and configured to rotationally bias the second centering member 20 in the counter-clockwise direction B towards the registration position. Although FIGS. 1-4 illustrate the biasing members 70A, 70B including torsional springs, one of ordinary skill in the art may appreciate that any suitable device configured to rotationally bias the respective centering members 10, 20 are also encompassed by the present disclosure. Additionally, in some aspects, the first and second biasing members 70A, 70B may include loading profiles that are identical with respect to each other for a particular amount of deflection.

As shown in FIG. 1, the first biasing member 70A includes a first end 71A and a second end 72A. The first biasing member 70A, and in particular, the first end 71A of the first biasing member 70A, may be operably engaged with the first centering member 10. For example, the first centering member 10 may include a first engaging element 18, which may extend along a direction parallel to the longitudinal axis X of the self-centering mechanism 1. According to some aspects, the first engaging element 18 may be configured to contact and/or be operably engaged with the first end 71A of the first biasing member 70A. Additionally or alternatively, the first end 71A of the first biasing member 70A may be securely affixed and/or attached to the first engaging element 18 of the first centering member 10. The second end 72A of the first biasing member 70A may be securely affixed and/or attached to a structure (e.g., the housing 5). The first and second ends 71A, 72A are connected together by a medial portion which may be wrapped about the shaft member 30. The first biasing member 70A is therefore configured as a torsion spring which normally biases the first centering member 10 toward the registration position. As such, rotation of the first centering member 10, and thus the first engaging element 18, in either the clockwise and/or counterclockwise direction A, B about the longitudinal axis X may provide for the first end 71A of the first biasing member 70A to also rotate about the longitudinal axis X in a corresponding fashion. Rotation of the rotatable shaft member 30, the support member 40, the actuating pin 60, the first centering member 10, and/or the first engaging element 18 about the longitudinal axis X in the counter-clockwise direction B may provide a linear load or a linearly increasing load on the first biasing member 70A. Thus, when the first engaging element 18, the first centering member 10, the actuating pin 60, the support member 40, and/or the rotatable shaft member 30 is disposed in a rotated position away from the registration position, as shown in FIG. 3, the first biasing member 70A may be configured to rotationally bias the first centering member 10, by way of the first engaging element 18, angularly about the longitudinal axis X towards the registration position.

Likewise, the second centering member 20 may include a second engaging member that extends along a direction parallel to the longitudinal axis X and/or parallel to the first engaging member 18, and extending from the second surface 27 of the second centering member 20. Further, the second biasing member 70B may also include a first end 71B and a second end 72B. In some aspects, the first end 71B of the second biasing member 70B, may be operably engaged with the second centering member 20, and in particular, may be operably engaged with the second engaging element. The first end 71B of the second biasing member 70B may be securely affixed and/or attached to the second engaging element of the second centering member 20. Further, the second end 72B of the second biasing member 70B may be securely affixed and/or attached to a structure (e.g., the housing 100). The first and second ends 71B, 72B are connected together by a medial portion which may be wrapped about the shaft member 30. The second biasing member 70B is therefore configured as a torsion spring which normally biases the second centering member 20 toward the registration position. As such, rotation of the second centering member 20, and thus the second engaging element, in either the clockwise and/or counterclockwise direction A, B about the longitudinal axis X may provide for the first end 71B of the second biasing member 70B to also rotate about the longitudinal axis X in a corresponding fashion. As such, the rotation of the rotatable shaft member 30, the support member 40, the actuating pin 60, the second centering member 20, and/or the second engaging element about the longitudinal axis X in the clockwise direction A may provide a linear load or a linearly increasing load on the second biasing member 70B. Thus, when the second engaging element, the second centering member 20, the actuating pin 60, the support member 40, and/or the rotatable shaft member 30 is rotated about the longitudinal axis X in the clockwise direction A to a rotated position away from the registration position, the second biasing member 70B may be configured to rotationally bias the second centering member 20, by way of the second engaging element angularly about the longitudinal axis X towards the registration position.

According to some aspects, as particularly shown in FIGS. 5A-5C, the self-centering mechanism 1 includes a single biasing member 70 that is directly and operably engaged with both the first and second centering members 10, 20. The biasing member 70 is further configured to rotationally bias each of the first and second centering members 10, 20 in opposing rotational directions about the shaft member 30 to the registration position. The biasing member 70 is further configured to bias each of the first and second centering members 10, 20 in opposite rotational directions about the shaft member 30 back toward the registration position upon rotation of the rotatable shaft member 30. In this regard, the support member 40 may further define a biasing support element 44 that extends from the support member 40 along a direction parallel to the longitudinal axis X of the self-centering mechanism 1, parallel to the stationary pin 50, parallel to the actuating pin 60, and/or parallel to the rotatable shaft member 30. Additionally, the biasing support element 44 may be radially or laterally spaced apart from the rotatable shaft member 30 so as to orbit about the rotatable shaft member 30 in response to rotation of the shaft member 30 in either of the opposing rotational directions. In some aspects, the support member 40 may be configured such that rotation of the rotatable shaft member 30 about the longitudinal axis X, either in the clockwise direction A and/or the counter-clockwise direction B, causes the biasing support element 44 and the actuating pin 60 to orbit about the rotatable shaft member 30 in directly corresponding angular intervals in the same rotational direction.

As shown in FIGS. 5A-5C, the biasing member 70 may be in communication with an anchoring structure (e.g., the biasing support element 44 comprising the anchoring structure may have a medial portion of the biasing member 70 wrapped thereabout). When the biasing support element 44 orbits about the longitudinal axis X of the self-centering mechanism 1 in either the clockwise direction A and/or the counter-clockwise direction B, the biasing member 70 may also orbit about the longitudinal axis X of the self-centering mechanism 1 in the same rotational direction. Further, as the biasing member 70 orbits about the longitudinal axis X of the self-centering mechanism 1 in response to rotation of the rotatable shaft member 30 in either of the rotational directions, the first end 71 of the biasing member 70 may directly engage and move along the curved or nonlinear peripheral surface 19 of the first centering member 10 and/or the second end 72 of the biasing member 70 may directly engage and move along the curved or nonlinear peripheral surface 29 of the second centering member 20. According to some aspects, the curved peripheral surfaces 19, 29 of the first and second centering members 10, 20 may define a nonlinear cam surface or nonlinear cam profile that includes one or more portions defining varying convexity.

As shown in FIG. 5B, when the biasing support element 44 and the biasing member 70 orbit about the longitudinal axis X of the self-centering mechanism 1 in response to rotation of the rotatable shaft member 30 in the counter-clockwise direction B via the actuating pin 60 operably engaging the first end 25 of the first arcuate slot 24 of the second centering member 20, the first end 71 of the biasing member 70 may travel a first distance along the curved or nonlinear peripheral surface 19 of the first centering member 10, while the second end 72 of the biasing member 70 travels a second distance along the curved or nonlinear peripheral surface 29 of the second centering member 20. Additionally, the first distance along the curved or nonlinear peripheral surface 19 that the first end 71 of the biasing member 70 travels along is greater than the second distance along the curved or nonlinear peripheral surface 29 that the second end 72 of the biasing member 70 travels along. Likewise, as shown in FIG. 5C, when the biasing support element 44 and the biasing member 70 orbit about the longitudinal axis X of the self-centering mechanism 1 in response to rotation of the rotatable shaft member 30 in the clockwise direction A via the actuating pin 60 operably engaging the second end 16 of the first arcuate slot 14 of the first centering member 10, the second end 72 of the biasing member 70 may travel along the curved or nonlinear peripheral surface 29 of the second centering member 20 a first distance that is greater than a second distance that the first end 71 of the biasing member 70 travels along the curved or nonlinear peripheral surface 19 of the first centering member 10. In some aspects, the second end 72 of the biasing member 70 may remain substantially stationary with respect to the curved or nonlinear peripheral surface 29 of the second centering member 20 in response to the rotatable shaft member 30 rotating in the counter-clockwise direction B. Additionally or alternatively, the first end 71 of the biasing member 70 may remain substantially stationary with respect to the curved peripheral surface 19 of the first centering member 10 in response to the rotatable shaft member 30 rotating in the clockwise direction A.

In some aspects, the direct engagement between the first end 71 and/or the second end 72 of the biasing member 70 with the curved or nonlinear peripheral surfaces 19, 29 of the first and second centering members 10, 20, respectively, may provide for a biasing force acting on the rotated one of the first and second centering members 10, 20 that varies in magnitude as the rotatable shaft member 30 rotates about the longitudinal axis X of the self-centering mechanism 1. For example, in some aspects, the biasing force acting on the rotated one of the first and second centering members 10, 20, as the rotatable shaft member 30 is rotated in either of the rotational directions away from the registration position, may initially be approximately 63 N-mm. As the rotatable shaft member 30 rotates further in either of the rotational directions away from the registration position, the biasing force acting on the rotated one of the first and second centering members 10, 20 by the biasing member 70 may decrease in magnitude. In some instances, the biasing force may decrease linearly in magnitude, in relation to the cam profile of the respective curved or nonlinear peripheral surfaces 19, 29 of the rotated one of the first and second centering members 10, 20 interacting with the biasing member 70. For example, as the first or second centering members 10, 20 is rotated in the first or second rotational directions approximately 30 degrees from the registration position, respectively, the biasing force imparted by the biasing member 70 may decrease to approximately 57 N-mm. According to another aspect, the biasing force may decrease logarithmically in magnitude, in relation to the cam profile of the respective curved or nonlinear peripheral surfaces 19, 29 of the rotated one of the first and second centering members 10, 20 interacting with the biasing member 70.

Additionally, although FIGS. 1-4 illustrate the support member 40 being shaped symmetrically along a length of the support member from the proximal end 41 to the distal end 42 of the support member 40, one of ordinary skill in the art may appreciate the support member 40 may be shaped asymmetrically along the length of the support member from the proximal end 41 to the distal end 42 of the support member 40. For example, when the first and second centering members 10, 20 are shaped irregularly with respect to one another, the self-centering mechanism 1 may include an asymmetrically shaped support member 40 to provide a user with rotational characteristics, when the rotatable shaft member 30 is rotated in the clockwise direction A, that are identical to rotational characteristics experienced when the rotatable shaft member 30 is rotated in the counter-clockwise direction B. Additionally or alternatively, the self-centering mechanism 1 may include a first biasing member 70A and a second biasing member 70B that have differing physical characteristics, but provide the user with identical rotational characteristics when the rotatable shaft member 30 is rotated in either the clockwise or the counter-clockwise direction A, B. For example, a first biasing member 70A configured as a torsion spring may include a different number of coils, materials, and/or the like compared to a second biasing member 70B that is also configured as a torsion spring.

Many modifications and other embodiments of the inventions set forth herein will come to mind to one skilled in the art to which these disclosed embodiments pertain having the benefit of the teachings presented in the foregoing descriptions and the associated drawings. Therefore, it is to be understood that embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

What is claimed is:

1. A self-centering mechanism comprising:

a first centering member defining a first arcuate slot and an opposed second arcuate slot;

a second centering member defining a first arcuate slot and an opposed second arcuate slot;

a rotatable shaft member extending through respective centers of the first and second centering members so as to be disposed between the first arcuate slots and the second arcuate slots;

a stationary pin extending through the first arcuate slots of the first and second centering members;

a support member extending radially from the rotatable shaft member, the support member being fixed with respect to the rotatable shaft member so as to be rotatable therewith and having an actuating pin extending therefrom and through the second arcuate slots of the first and second centering members; and at least one biasing member arranged to rotationally bias the first and second centering member in opposed rotational directions to a registration position defined by interaction of the first arcuate slots with the stationary pin, wherein the actuating pin is responsive to rotation of the rotatable shaft member in one of the rotational directions to engage the second arcuate slot of one of the first and second centering members and to rotate the one of the first and second centering members with the actuating pin, and the one of the first and second centering members being responsive to the at least one biasing member to rotate back to the registration position upon release of the rotatable shaft member.

2. The mechanism of claim 1, further comprising:

a first engaging element extending from a first surface of the first centering member; and a second engaging element extending from a second surface of the second centering member, wherein the at least one biasing member is circumferentially disposed about a longitudinally-extending circumferential surface of the rotatable shaft member.

3. The mechanism of claim 2, wherein the at least one biasing member comprises a first biasing member that includes a first end and a second end and a second biasing member that includes a first end and a second end, the first end of the first biasing member being directly engaged with the first engaging element and the second end thereof being arranged to remain stationary so as to rotationally bias the first centering member in one of the opposed rotational directions, and the first end of the second biasing member being directly engaged with the second engaging element and the second end thereof being arranged to remain stationary so as to rotationally bias the second centering member in the other of the opposed rotational direction.

4. The mechanism of claim 3, wherein the first biasing member is configured to exert a first biasing force on the first centering member that is equal to a second biasing force exerted on the second centering member by the second biasing member.

5. The mechanism of claim 1, wherein the at least one biasing member is circumferentially disposed about a longitudinally-extending circumferential surface of the rotatable shaft member to rotationally bias the first and second centering members, the at least one biasing member being further configured to have a linear loading profile with respect to rotational travel of the rotatable shaft member.

6. The mechanism of claim 1, wherein the first arcuate slots and the second arcuate slots of the first and second centering members each define a first end and a second end, and wherein the first and second centering members are rotationally biased such that the stationary pin is engaged with the first end of the first arcuate slot of the first centering member and the second end of the first arcuate slot of the second centering member when the rotatable shaft member is disposed in the registration position.

7. The mechanism of claim 6, wherein the actuating pin extending from the support member and through the second arcuate slots of the first and second centering members engages the second end of the second arcuate slot of the first centering member and the first end of the second arcuate slot of the second centering member when the rotatable shaft member is disposed in the registration position.

8. The mechanism of claim 7, wherein the rotatable shaft member, the support member, and the actuating pin are configured to cooperate such that rotation of the rotatable shaft member in one rotational direction causes the actuating pin to engage one end of the second arcuate slot of one of the first and second centering members and to rotate the one of the first and second centering members in that one rotational direction, while the actuating pin moves along the second arcuate slot of the other of the first and second centering members without rotating the other of the first and second centering members, and while the first arcuate slot of the one of the first and second centering members moves with respect to the stationary pin.

9. The mechanism of claim 6, wherein the first arcuate slots of the first and second centering members are configured such that rotation of the rotatable shaft member is limited by the stationary pin engaging the same ends of the first arcuate slots of the first and second centering member.

10. The mechanism of claim 9, wherein the second arcuate slots of the first and second centering members are configured such that rotation of the rotatable shaft member is limited by the actuating pin engaging the same ends of the second arcuate slots of the first and second centering member.

11. The mechanism of claim 10, wherein the first arcuate slots and the second arcuate slots of the first and second centering members are configured to limit rotation of the rotatable shaft member in either rotational direction from the registration position to 30 degrees.

12. The mechanism of claim 1, wherein the first centering member and the second centering member are configured as circular disks, with the first centering member defining a radius equal to a radius of the second centering member.

13. The mechanism of claim 1, further comprising a biasing support element extending from the support member, the at least one biasing member being circumferentially disposed about a longitudinally-extending circumferential surface of the biasing support element, wherein the biasing support element is responsive to rotation of the rotatable shaft member to orbit about the rotatable shaft member in one of the rotational directions.

14. The mechanism of claim 13, wherein the at least one biasing member includes a first end directly engaged with a peripheral surface of the first centering member and a second end directly engaged with a peripheral surface of the second centering member, and wherein the at least one biasing member is responsive to rotation of the rotatable shaft member such that the first end moves along the peripheral surface of the first centering member upon rotation of the rotatable shaft member in a first rotational direction and the second end moves along the peripheral surface of the second centering member upon rotation of the rotatable shaft member in an opposing second rotational direction.

15. The mechanism of claim 14, wherein the peripheral surfaces of the first and second centering members each define a nonlinear cam profile, and wherein the at least one biasing member is configured to cooperate with the respective peripheral surfaces to exert a decreasing first biasing force on the first centering member upon rotation of the first centering member in the first rotational direction away from the registration position, and to exert a decreasing second biasing force on the second centering member upon rotation of the second centering member in the opposing second rotational direction away from the registration position.

16. The mechanism of claim 15, wherein the first biasing force exerted on the first centering member and the second biasing force exerted on the second centering member upon rotation of the first and second centering members respectively decrease logarithmically.

17. The mechanism of claim 1, wherein the support member defines an arcuate slot defining a first end and a second end, and the stationary pin extends through the support member arcuate slot, and wherein the support member arcuate slot is configured such that rotation of the rotatable shaft member is limited by the stationary pin engaging one of the first end and the second end thereof.

18. The mechanism of claim 17, wherein the rotatable shaft member, the support member, and the actuating pin are configured to cooperate such that rotation of the rotatable shaft member in one rotational direction causes the actuating pin to engage one end of the second arcuate slot of one of the first and second centering members and to rotate the one of the first and second centering members in the one rotational direction, while the support member arcuate slot moves with respect to the stationary pin.

19. The mechanism of claim 17, wherein the stationary pin extends through a midpoint of the support member arcuate slot when the first and second centering members are disposed in the registration position.

* * * * *